United States Patent [19]

Reinhall et al.

[11] Patent Number: 4,954,221

[45] Date of Patent: Sep. 4, 1990

[54] APPARATUS FOR FEEDING LIGNOCELLULOSE-CONTAINING MATERIAL THROUGH A STEAM SCREEN INTO A REFINER

[75] Inventors: Rolf B. Reinhall; Johan G. I. Johansson, both of Bellevue, Wash.; Anders V. Mokvist, Eden Prairie, Minn.

[73] Assignee: Sunds Defibrator Aktiebolag, Sundsvall, Sweden

[21] Appl. No.: 681,847

[22] PCT Filed: Apr. 3, 1984

[86] PCT No.: PCT/SE84/00120

§ 371 Date: Nov. 19, 1984

§ 102(e) Date: Nov. 19, 1984

[87] PCT Pub. No.: WO84/04113

PCT Pub. Date: Oct. 25, 1984

[30] Foreign Application Priority Data

Apr. 12, 1983 [SE] Sweden ..... 8302014

[51] Int. Cl.[5] ..... D21B 1/26

[52] U.S. Cl. ..... 162/261; 162/18; 162/23; 162/46; 241/28; 241/245

[58] Field of Search ..... 162/18, 56, 52, 246, 162/23, 68, 261, 28, 46, 23, 15, 46; 55/452, 446; 241/244, 245, 28

[56] References Cited

U.S. PATENT DOCUMENTS

| | | | |
|---|---|---|---|
| 2,072,086 | 3/1937 | Ruza, Sr. | 162/18 |
| 2,988,064 | 8/1961 | Lang | 162/251 |
| 3,471,366 | 10/1969 | Reinhall | 162/18 |
| 4,037,792 | 7/1977 | Peterson | 162/23 X |
| 4,163,525 | 8/1979 | Reinhall | 162/261 |
| 4,283,252 | 8/1981 | Reinhall | 162/23 |
| 4,421,595 | 12/1983 | Huusari | 162/23 |

*Primary Examiner*—Steve Alvo

*Attorney, Agent, or Firm*—Burns, Doane, Swecker & Mathis

[57] ABSTRACT

In a refiner (40) with two opposed discs (47,48) rotatable relative to each other fibre pulp is manufactured from lignocellulose-containing material. The material is advanced in a channel comprising a plug pipe (20), through which the material is fed in compressed state, and a steam screen pipe (32) for discharging steam. The steam screen pipe (32) is located directly after the plug pipe (20) and has a cross-sectional area, which slightly exceeds that of the plug pipe in order to allow a limited expansion of the material plug. The steam is thereby allowed to flow through the material, at the same time as the material plug prevents clogging of the apertures (37,39) of the steam screen pipe.

4 Claims, 2 Drawing Sheets

APPARATUS FOR FEEDING LIGNOCELLULOSE-CONTAINING MATERIAL THROUGH A STEAM SCREEN INTO A REFINER

This invention relates to a method and an apparatus for bleeding and cleaning steam generated or supplied at the making of fibre pulp from lignocellulose-containing material, for example soft- or hardwood chips, bamboo, straw, bagasse etc. The invention comprises mechanic disintegration of chemically processed or unprocessed material at increased temperature to fibrous state in a refiner comprising at least two discs, which are rotatable relative to one another and enclosed in an air-tight casing, and the surfaces of which have plane, conic or spherical design or a combination thereof Opposed refiner discs, thus, may be rotatable in opposite directions, or one disc may be rotary and the other one stationary.

The mechanic disintegration of the material is carried out after the material has been fed to the refiner by means of a compressing feed screw, which forms the material to a plug capable to resist the stream pressure arising in the refiner. The disintegration or refining of the material requires a varying amount of electric or steam energy (50–500 kWh/ton), depending on the type of fibre pulp being manufactured. The processing temperature normally is 100°–250° C. The energy amount supplied to the refiner for separating the material to fibres and, respectively, fibrils to a great extent is converted into heat whereby, owing to the evaporation of the water following along with the material, steam is generated in the disc gap. The steam amount generated at the higher energy charges is very great. In order to prevent the material thereby from assuming too high a dry content, it is known during the refining process proper to supply water to the disc gap, so that a desired water content in the material is maintained and the material is not damaged by overheating.

It is also known to allow part of the steam amount generated at the refining to flow rearward, against the direction of the supplied material, through the feed opening of the refiner and to bleed the excess of this steam amount. Steam and material can thereby be separated by means of a steam screen, which is provided with mechanic scrapers for removing material particles, which have deposited on the steam screen, as disclosed in SE-PS 7700047-9.

According to the invention, the requirement of these scrapers is eliminated and has been replaced by a charging device, at which the supplied material itself removes fibres and other particles desposited on the steam screen.

The characterizing features of the invention become apparent from the claims.

BRIEF DESCRIPTION OF THE DRAWINGS

In the following, some embodiments of the invention are described in greater detail, with reference to the accompanying drawings, in which

In FIG. 1 the numeral 10 designates an inlet opening for the material to a screw feeder 14 comprising a feed screw 12, which compresses the material and feeds the material supplied to the process in compressed state to a plug pipe 20. The said feed screw 12 thereby produces in known manner a sealing plug of the material, so that a steam and/or gas pressure above atmospheric pressure can be maintained in the continuation of the feed channel extending to the refiner.

Figure 1:
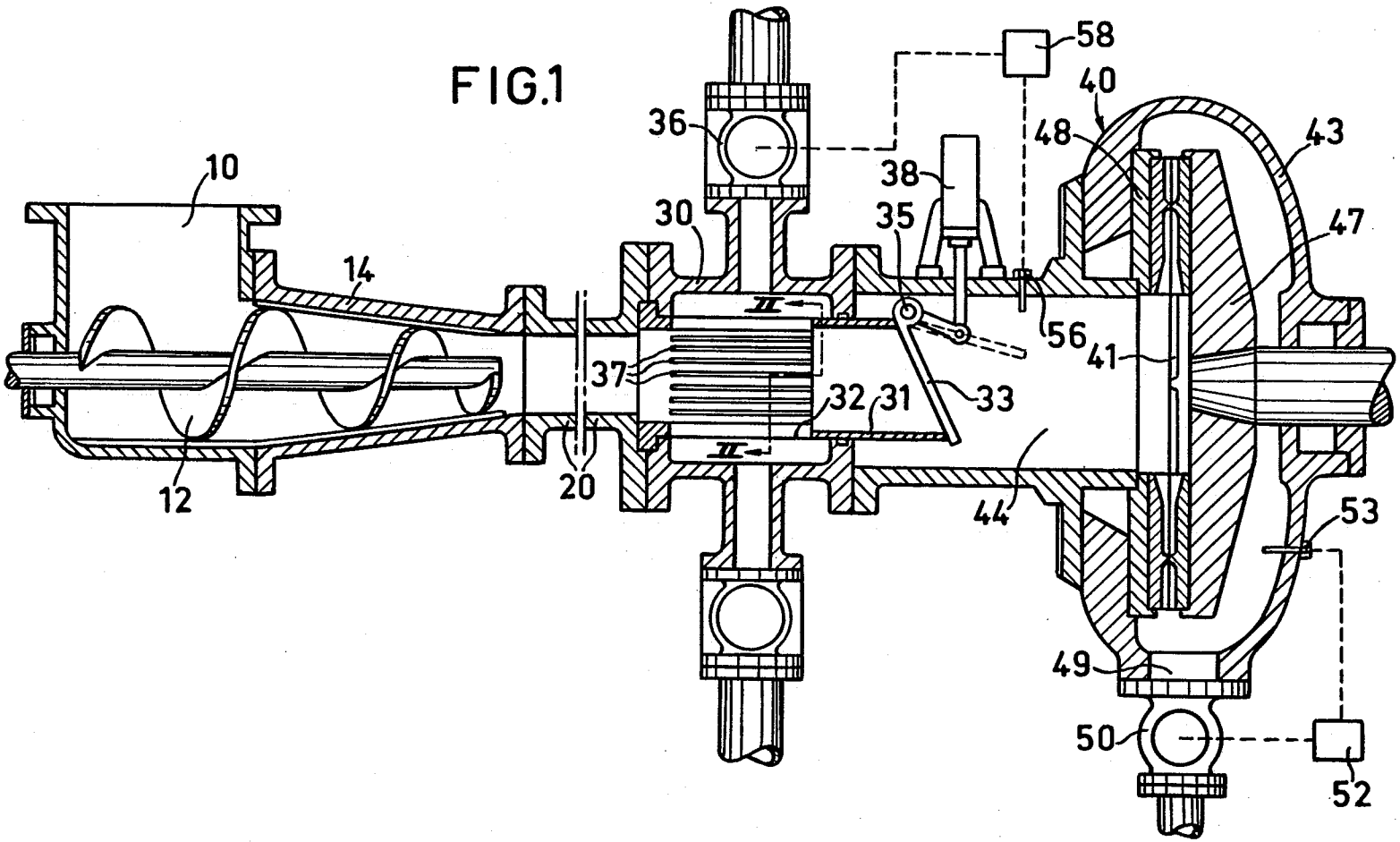
FIG. 1 is a schematic section of a refiner with a feed channel according to the invention.
Figure 2:
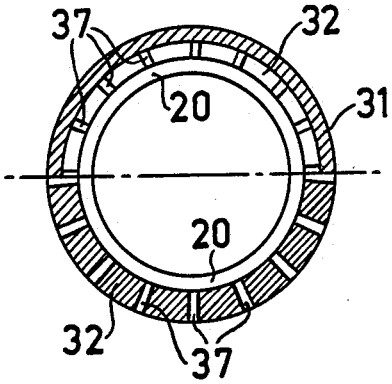
FIG. 2 is a section according to II—II in FIG. 1 on an enlarged scale.
Figure 3:
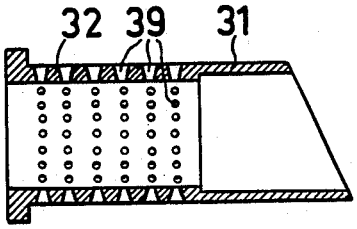
FIG. 3 shows an alternative design of a portion of the feed channel.

The material continuously supplied pushes the material compressed in the plug pipe 20 over to a steam screen pipe 32, which has a slightly greater area and is provided with apertures in the form of slits 37 or perforations 39. Steam can flow through these apertures out to an outer casing 30.

At the transfer of the material from the outer plug pipe 20 to the steam screen pipe 32 with slightly greater area, the material plug supplied is somewhat loosened, due lo the increase in area. Steam can thereby flow rearward from the refiner and be discharged through the apertures 37,39, while the supplied material, owing to its remaining compression, presses against the slitted or perforated surfaces in the steam screen pipe 32. Material screened there and accumulated is thereby scraped off efficiently and flows along with the material to the refiner.

This scraping effect can be adjusted to desired contact pressure by means of a holder-on member 33 in the form of a cover, which co-operates with a pipe portion 31 in direct connection to the feed pipe 32. By means of a pressing device 38 and a lead-in axle 35, the holder-on member 33 can be pressed against the material fed-in. Said holder-on member 33 also acts as a protection against sudden steam outflow in rearward direction through the screw feeder 14, which outflow may be caused by disturbances in the material supply giving rise to too low a compression in the plug pipe 20.

The material supplied is thereafter pushed on into the inlet opening 44 of the refiner 40, from where it is introduced by means of a central ejection wing 41 to the refiner discs 47 and 48 and the gap maintained therebetween. The material to be refined passes through the gap in outward direction to a surrounding air-tight refiner casing 43 and is thereby disintegrated so that the individual fibres and, respectively, fibrils are separated from each other entirely or partially.

The completely processed fibres and the greater part of the steam supplied or generated during the refining process are discharged from the refiner casing 43 through a discharge opening 49, to which a discharge device 50 is connected, which is controlled so that a desired steam pressure is maintained outside the refiner discs. This control is effected by a pressure-scanning member 53 and a control member 52 actuating the discharge device 50.

Part of the steam generated at the refining process flows from the inlet zone of the gap inward to the rotation centre and continues against the direction of the material entering the inlet opening 44. This steam is led away from the steam screen pipe 32 to the enclosing casing 30 through the slits 37 or perforations 39.

Particles of processed or unprocessed material which are taken along by the rearward directed steam flow are separated on the slitted or perforated inner screen surface of the steam screen pipe 32. At the same time, the material slidingly advancing on the screen surface and pressed against the same ensures, that the particles separated and deposited on the screen surface are scraped off and returned to the refining process. The apertures 37,39 in the steam screen pipe 32 are hereby maintained open all the time, so that clogging is prevented.

The casing 30 is provided with a discharge and pressure control valve 36, which by means of a pressure-scanning member 56 and a control member 58 maintains the steam pressure desired in the inlet zone of the refiner. The steam amount bleeding through the apertures 37,39 simultaneously has been freed from solid impurities, which may give rise to problems when the steam is being recycled in or outside the process.

In those cases when the steam screen pipe 32 is provided with slits 37, the slits preferably are designed axially so as to extend in parallel with the feed direction of the material. The slits further should be designed so that the slit width inward to the material is smaller than the slit width outward to the enclosing casing 30. Due to the fact, that the pipe portion 31 connected to the steam screen pipe 32 is designed with a slightly greater area than the steam screen pipe, and the slits 37 extend all the way to the pipe portion 31, the risk is reduced that particles accumulate at the end of the slits. Subsequent particles, thus, unobstructed by the pipe portion 31, take along from the end of the steam screen pipe 32 those particles, which may have penetrated a distance into the slits 37.

When the steam screen pipe 32 is designed with apertures in the form of perforations 39, The perforations should have an area increasing radially outward from the material. The perforations, further, should be directed obliquely rearward, seen in the feed direction of the material Hereby the risk of clogging is reduced. In order to reduce this risk still more, the perforations can be designed so that the leading edge of the hole is higher than the trailing edge, seen in the feed direction of the material. The invention, of course, is not restricted to the embodiments described above, but can be varied within the scope of the invention idea.

We claim:

1. An apparatus for making fibre pulp from lignocellulose-containing material, comprising a refiner provided with at least two opposed refiner discs, the refiner discs being rotatable relative to each other and defining a gap therebetween, a feed channel including a plug pipe of predetermined cross-sectional area and an inlet opening for feeding the material to the gap in a compressed state, wherein a steam screen pipe is positioned directly downstream from the plug pipe, the steam screen pipe being provided with apertures for discharging steam, the steam screen pipe having a cross-sectional area slightly greater than the predetermined cross-sectional area of the plug pipe, the apertures being provided as axially directed slits extending adjacent to a channel section having a cross-sectional area greater than the cross-sectional area of the steam screen pipe.

2. An apparatus as defined in claim 1, wherein an adjustable hold-on member is positioned downstream of the steam screen pipe to control the material flow and thereby the contact pressure of the material against the walls of the steam screen pipe.

3. An apparatus for making fibre pulp from lignocellulose-containing material, comprising a refiner provided with at least two opposed refiner discs, the refiner discs being rotatable relative to each other and defining a gap therebetween, a feed channel including a plug pipe of predetermined cross-sectional area and an inlet opening for feeding the material to the gap in a compressed state, wherein a steam screen pipe is positioned directly downstream from the plug pipe, the steam screen pipe being provided with apertures for discharging steam directly after the plug pipe, the steam screen pipe having a cross-sectional area slightly greater than the predetermined cross-sectional area of the plug pipe, the apertures being provided as perforations with a radially outwardly increasing area.

4. An apparatus as defined in claim 3, wherein an adjustable hold-on member is positioned downstream of the steam screen pipe to control the material flow and contact pressure of the material against the walls of the steam screen pipe, the contact pressure cleaning the apertures during passage of the material therethrough, the hold-on member comprising a cover element and a cover element control means for adjusting the cover element with respect to the steam screen pipe and preventing steam outflow through said plug pipe.

* * * * *